United States Patent [19]

Wolfson et al.

[11] 4,356,496

[45] Oct. 26, 1982

[54] LOOP-COUPLER COMMUTATING FEED FOR SCANNING A CIRCULAR ARRAY ANTENNA

[76] Inventors: Ronald I. Wolfson, 10966 Beckford Ave., Northridge, Calif. 91326; Ching-Fai Cho, 13083 Rajah St., Sylmar, Calif. 91342

[21] Appl. No.: 231,383

[22] Filed: Feb. 4, 1981

[51] Int. Cl.[3] ..... H01Q 3/24; H01Q 3/32

[52] U.S. Cl. ..... 343/854; 333/107

[58] Field of Search ..... 343/853, 854, 876; 333/106, 107

[56] References Cited

U.S. PATENT DOCUMENTS 4,229,746 10/1980 Charlton ..... 343/854

*Primary Examiner*—Eli Lieberman

[57] ABSTRACT

A multiple-port loop-coupled commutating feed for a circular or cylindrical antenna array which is circumferentially scanned. A rotor assembly having a plurality of elongated coupling loops circumferentially spaced about an arc of its perimeter is fed from a stripline feed configuration excited at the driven central axis of the rotor. The rotor loops are formed by extension of printed circuit traces extant within the stripline feed about an arc of the rotor assembly. A plurality of elongated stator loops with essentially the same radial dimensions as the aforementioned rotor loops is provided, however the stator loops are distributed throughout the full 360° of the circular perimeter of the device to continuously couple a changing fraction of the stator loops to the rotor as the latter is rotated. An output port is provided connected to each stator loop and these output ports may then be discretely connected to corresponding elements of a circular array or columns of elements of a cylindrical array.

7 Claims, 3 Drawing Figures

ROTOR LAYOUT - STRIPLINE FEED NETWORK

LOOP-COUPLER COMMUTATING FEED FOR SCANNING A CIRCULAR ARRAY ANTENNA

The Government of the United States has rights in this invention pursuant to Contract F19628-79-C-0034, awarded by the Department of The Air Force.

BACKGROUND OF THE INVENTION

1. Field of the Invention

The invention relates to radar systems generally, and more particularly to systems for feeding circular or cylindrical arrays to generate a predetermined radar beam continuously rotatable about the 360° circular or cylindrical array perimeter.

2. Description of the Prior Art

A device of the specific type to which the present invention relates is described in U.S. Pat. No. 4,229,746, assigned to the assignee of this application. In that prior patent, a multiple port loop-coupler is provided which acts as a commutating feed for a circular or cylindrical array. A rotor has a plurality of elongated coupling loops circumferentially spaced about an arc of its perimeter, the arc being less than 360°. A stripline drive is incorporated into the rotor and the elongated magnetic loops of the rotor are interfaced with the outer perimeter of the stripline feed arrangement. One conductive plane of the stripline configuration is extended radially outward and the individual elongated coupling loops are free-standing in a plane parallel to this extended conductive plane. The radially outward ends of these conductive loops are return-circuited to the aforementioned conductive plane of the stripline at their radially outward extremes, the conductive plane thereby providing a return circuit for all of the discrete elongated coupling loops.

The aforementioned U.S. Pat. No. 4,229,746 describes the operation and interface of these rotor loops with the stator loops built into the cavity formed between conductive planes in the fixed stator structure. The multiple stator ports are directly connected to the fixed stator loops, whereas the rotor loops through the stripline feed configuration are fed from a common port near the axis of rotation of the rotor assembly.

The apparatus according to the aforementioned U.S. Pat. No. 4,229,746 has been found to be electrically satisfactory, however the cost of manufacturing, especially accurately positioning the free standing elongated rotor magnetic loops has been greater than expected.

In accordance with the foregoing, the manner in which the invention reduces costs and improves producibility of the apparatus will be understood as this description proceeds.

SUMMARY OF THE INVENTION

According to the invention there is provided a non-contacting, loop-coupled microwave commutator of the general type described in U.S. Pat. No. 4,229,746 with simplified and less costly structural innovations.

The structural innovations aforementioned comprise the extension of the stripline central dielectric plane on which the printed circuit traces within the stripline are placed to the perimeter of the area in which the elongated magnetic coupling loops of the rotor are deployed. The coupling loops themselves can then be extensions of the stripline printed circuit traces. The conductive stripline plane is extended to substantially the same radial extremity to which the elongated magentic loop couplers are deployed in the aforementioned prior art device.

It will be evident from the foregoing and from the detailed description hereinafter, that the elongated magnetic coupling loop legs which were previously free standing metallic members may now be manufactfured directly on the dielectric sheet at the same time as the internal circit traces of the stip-line feed assembly are deposited. Conductive pins joining the radially outward extremity of each of the printed circuit loop legs, according to the invention to the conductive plane extending parallel to and spaced from the aforementioned dielectric plane, operate to complete the coupling loop circuit through the said conductive plane in a manner electrically equivalent to that effected in the prior art. Since the printed circuit loop legs are deposited on a supportive dielectric plane, the provision of the aforementioned conductive pegs to complete the loop circuit at the radial extremity of the rotor is easily effected.

The cost saving and manufacturing convenience advantages accruing to the invention will be understood more fully as this description proceeds.

DETAILED DESCRIPTION OF THE PREFERRED EMBODIMENT

Figure 1:
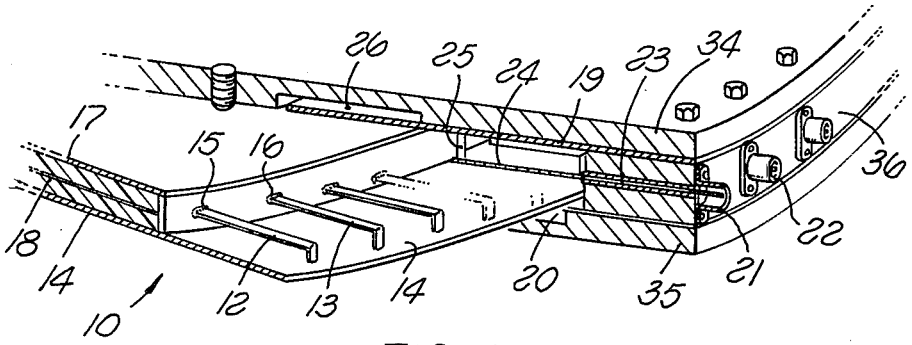
FIG. 1 PRIOR ART
FIG. 1 is a prior art implementation of a device to which the present invention is applicable.

Referring now to FIG. 1, the apparatus therein depicted is that disclosed and described in the aforementioned U.S. Pat. No. 4,229,746. Shown generally at 10 in FIG. 1 is a typical section of a portion of a commutating feed arrangement having branch ports ordinarily extending about the full 360° of the outer perimeter of the feed assembly, branch ports 21 and 22 being represented by coaxial connectors typical of all branch ports of the device. The stator sub-assembly comprises plate-like housing members 34 and 35 forming a cavity radially inward from the branch ports and within the volume radially bounded by the inside edge of an annular member 36. Coaxial stubs, typically 23, connect their corresponding branch ports discretely to a corresponding elongated stator loop-leg such as 24 for example. A conductive post 25 returns the loop-leg 24 to the conductive plane 19. A conventional choke cavity 26 acts to isolate the space between the rotor plane 17 and conductive plane 19 from the rotor/stator coupling area. Similarly, a choke section may be incorporated in the space generally at 20.

The rotor assembly of FIG. 1 comprises a strip transmission line of generally circular shape rotatable about a common rotor/stator center. This rotor stripline comprises conductive planes 14 and 17 with a plurality of stripline center conductors such as 18, all suspended by a solid dielectric (for example) between 14 and 17.

As the stripline center conductors emerge at the radially outward extremity of the stripline assembly, they are connected to corresponding rotor elongated loop legs such as 12 and 13 and are electrically returned to the extended conductive plane 14 of the stripline.

It will be noted that for the electrical and mechanical connection of loop legs 12 and 13 (FIG. 1) to the stripline center conductors, joints such as 15 and 16

(soldered for example) must be provided. Quite obviously, for alignment accuracy, elaborate jigging is necessary while these joints, such as 15 and 16, are effected. Much hand work is necessary, adding considerably to the manufacturing cost of the prior art assembly of FIG. 1.

Figure 2:
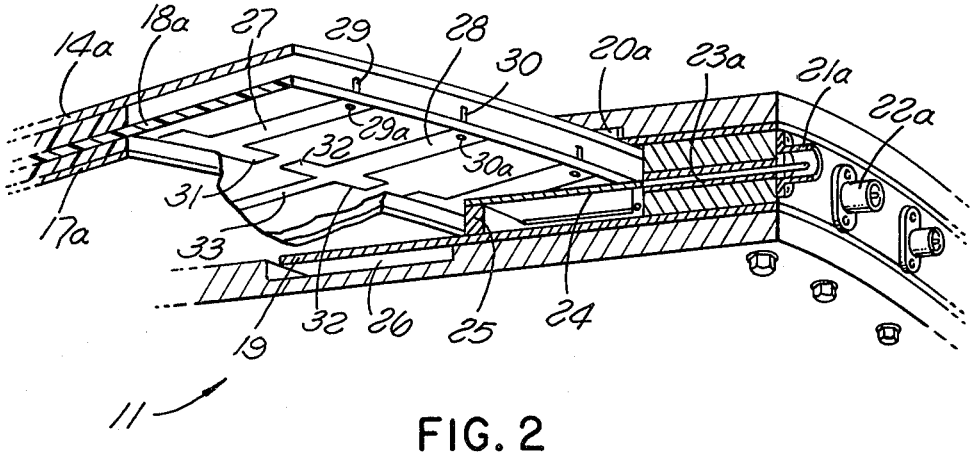
FIG. 2 is an implementation of a device similar to that of FIG. 1 except incorporating the invention therein.

Referring now to FIG. 2, a section of the device of the invention similar to that of the prior art device of FIG. 1 is shown, except that it is inverted, vis-a-vis the showing of FIG. 1. That is, the conductive plate 14 is on the top of the rotor assembly of FIG. 2 as 14*a*, and the other stripline conductive plane 17 is on the bottom as shown in FIG. 2 as 17*a*. The annular cavity in the stator assembly is obviously also inverted, although it is otherwise identical with the stator assembly of FIG. 1. Accordingly, the improvement of the assembly 11 of FIG. 2 is entirely within the rotor assembly.

In FIG. 2, the dielectric plane 18*a* supporting the extended stripline center conductors is extended radially outwad substantially congruent with the conductive plane 14*a*. The other stripline conductive plane 17*a* has a radial dimension substantially that of 17 of FIG. 1.

In lieu of the free standing loop legs of the rotor of FIG. 1, electrically equivalent loop legs are provided by printed circuit traces such as 27 and 28 on the extended dielectric plane 18*a* in FIG. 2. Corresponding conducive pins 29 and 30 provide the circuit return paths to conductive plane 14*a* for 27 and 28. AT 29*a* and 30*a*, respectively, are the heads of conductive pins 29 and 30, these being soldered or otherwise conductively affixed in place. It will be realized that the configuration of FIG. 2 eliminates all of the expensive operations in forming and placing the free standing rotor loop legs in the arrangmeent of FIG. 1. The loop legs 27 and 28 are now extensions of the stripline center conductors typically 33 which is integrally joined to 28 and produced as a printed circuit arrangement which will be seen in its overall form in FIG. 3. The matching stubs 31 and 32 are required because the stripline center conductor 33 passes out of the space between the two conductive planes 14*a* and 15*a* at those points with consequent impact on the impedance relationships. The design of the stubs 31 and 32 is conventional and well understood by those skilled in the stripline and microstrip arts. The factors affecting trace impedances throughout the rotor assembly are likewise determinable by those of skill in the art and therefore widths of traces, conductive plane spacing and like parameters can be appropriately selected to provide substantial electrical equivalence to the arrangement of FIG. 1, at least in the overall sense.

Figure 3:
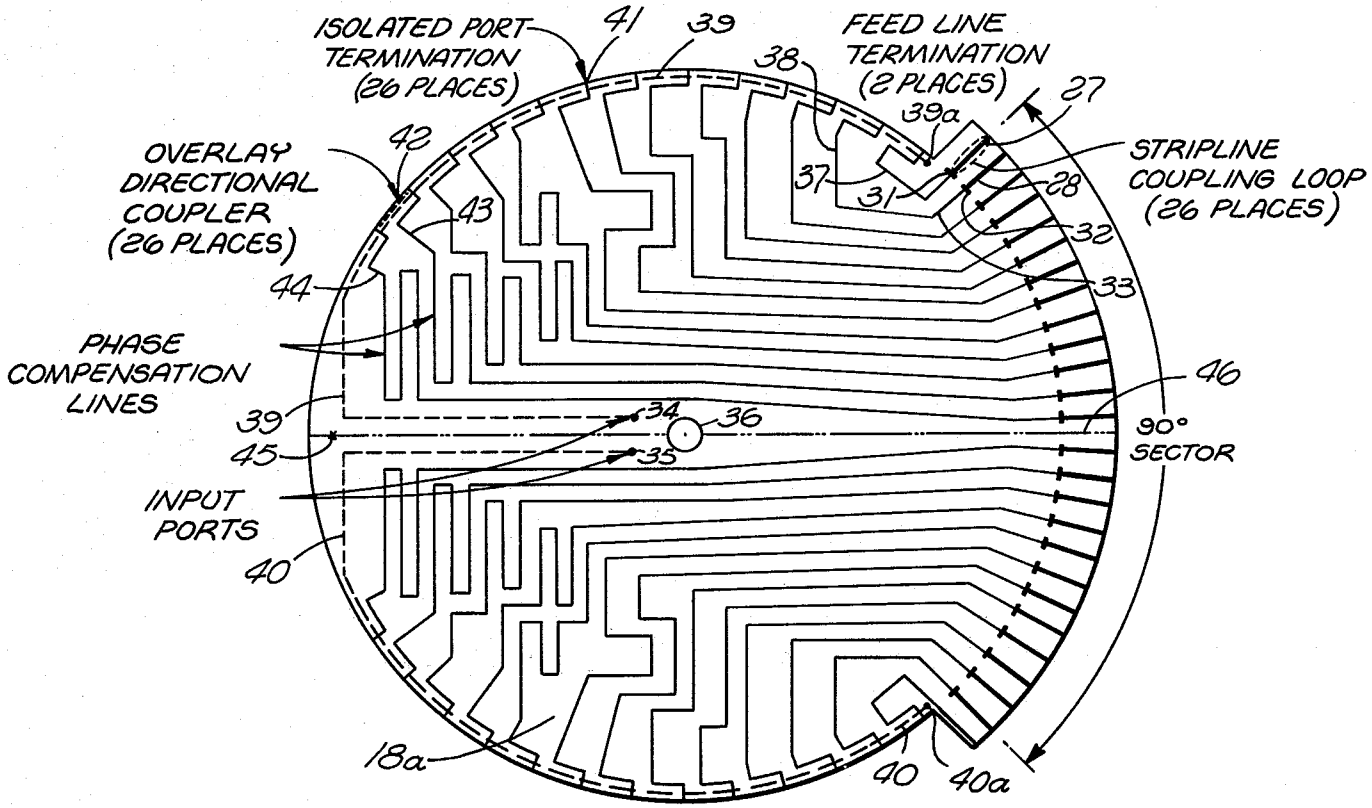
FIG. 3 is a typical layout of the printed circuit rotor assembly for use in the apparatus of FIG. 2.

Referring now to FIG. 3, the layout of the stripline rotor (center conductor between conductive planes 14*a* and 17*a* of FIG. 2) is depicted from the 17*a* side (FIG. 2) removed from the assembly of FIG. 2.

In the example shown in FIG. 3, 26 rotor loops are provided over a 90° sector. 27 and 28 are identified for correspondence with FIG. 2, as are matching stubs 31 and 32.

To accommodate the available sheet size of suitably low-loss dielectric sheet material and conventional circuit printing machinery for applying the conductive traces of FIG. 3, a dielectric board 18*a* was fabricated in two parts joined at centerline 46 in one practical model of the device. For this reason, separate input ports 34 and 35 were provided, these being fed from the branches of a 3dB coupler (power divider) associated with a rotating coaxial joint at the center of rotation 36. Ports 34 and 35 are fed as nearly as possible in-phase. The power divider for that purpose is entirely conventional and not a novel part of the present combination and it is therefore not shown. If dielectric board 18*a* were in fact a single homogeneous sheet, the power divider could be located in the vicinity of point 45 feeding 39 and 40 as branches, and in that case a single feed line trace from a single input port associated with 36 would be employed. The dashed-line circuit traces are to be understood to be on the opposite side of the circuit board, vis-a-vis solid traces such as 43, 44, etc. Distribution lines 39 and 40 proceed from the vicinity of point 45 around the perimeter of the dielectric board 18 to the angular extremities of the coupling loop section, as illustrated. The feed traces such as 37, 38, 43 and 44 are tailored to a specific length by means of their meandering shapes. The purpose of these predetermined path lengths is the ultimate provisions of an in-phase wave front in a circular or cylindrical array fed from the ports 21*a*, 22*a*, etc.

As the distribution lines 39 and 40 proceed about the perimeter of the dielectric board 18*a*, a plurality of discrete directional couplers is provided typically at 42. These directional couplers are basically four port devices, each having a port into which the corresponding distribution line 39 or 40 enters, and another from which it emerges and proceeds. The other two ports are connected, one to the corresponding phase compensated line such as 37, 38, 43 or 44 (26 such lines total in the example of FIG. 3), and the other (fourth port) being terminated as an isolated port. The latter is represented typically at 41. The distribution lines 39 and 40 are terminated conventionally by placement of resistive elements at 39*a* and 40*a*, respectively. The directional couplers (26 in number) of which 42 is typical, are conventional stripline implemented circuits well-known to those of skill in this art. The couplers 42 need not have the same coupling factor, i.e. they may be varied so that amplitude taper across the 90° sector of the rotor stripline loops is obtained. Amplitude taper is of course desirable for antenna side-lobe level control and other purposes as well-known to those of skill in this art. Phase trimmers or verniers may be provided to compensate for the inevitable minor phase disparities due to unequal path lengths from the input ports 34 and 35 to the actual elements of a cylindrical or circular array associated with the scanning feed network of the invention. Phase trimmers may be included in the lines such as 37 and 38, etc., these typically involving known structures for modifying the capacitive loading at two discrete points along the lines separated by a quarter-wavelength. A simple screw introduced at each of those quarter-wave separated points can effectively introduce a variable capacitance to the conductive ground plane of the stripline for the purpose.

The basic stripline technology and the printed circuit methods required for fabrication of the FIG. 3 rotor structure are well-known per se. Suitable materials for the device are readily selected by the skilled practitioner.

Variations and modifications on the specific structure disclosed and described will suggest themselves to those of skill in this art, once the invention is understood. Accordingly, it is not intended that the scope of the invention should be regarded as limited by the drawings or this description.

What is claimed is:

1. A loop coupler commutating feed for a scanning circular array, comprising:

a stator assembly having a conductive body member in the general shape of an annulus having a cavity therein such that the cross-section of said annulus is generally U-shaped opening radially inward, said stator assembly also comprising a plurality of circumferentially distributed stator loops each radially elongated within said cavity, each of said stator loops having its elongated leg current paths in a radially extending plane normal to the plane of said annulus;

a rotor assembly including a conductive disc rotatable about its center, said center being substantially coincident with the geometric center of said annulus, said rotor assembly also including a plurality of rotor loops circumferentially spaced about an arcuate portion of said disc, said rotor loops also being radially elongated and each having its elongated leg current paths in radially extending planes normal to the plane of said disc, the plane of said disc being substantially parallel to a plane through said annulus normal to the axis of said rotor and through the center of said annulus, said disc extending radially into said cavity such that said rotor loops couple to an arc of said stator loops in juxtaposition with said rotor loops over said arcuate portion of said disc, said coupling effecting energy transfer between said rotor and stator loops to a changing arcuate portion of said stator loops as said disc is rotated;

first means within said rotor assembly comprising a dielectric substrate spaced parallel to said conductive disc and rotatable with and about said conductive disc center, said substrate and said disc being substantially congruent;

second means comprising a feed network having a conductor trace on the surface of said substrate discretely connected to each of said rotor loops;

third means comprising a second conductive disc spaced from and parallel to said dielectric substrate on the side thereof opposite said conductive disc, said discs and said conductor traces on said substrate surface forming a multiple stripline arrangement;

fourth means comprising a conductive trace extension of each of said traces on said dielectric substrate, said conductive extensions extending beyond the radial extremity of said second conductive disc to form legs of said rotor loops;

fifth means comprising a conductive connection between the radially outward extremity of each of said conductive extensions and said conductive disc, said conductive extensions facing said stator loops;

sixth means for providing a feed connection between said conductive traces within said stripline and at least one common port;

and seventh means comprising a plurality of stationary second ports each discretely connected to a corresponding one of said stator loops.

2. Apparatus according to claim 1 in which said sixth means comprises at least one distribution feedline trace extending from said common port about the perimeter of said substrate and a directional coupler implemented in stripline medium connecting each of said conductive traces to said distribution feedline traces whereby a predetermined fraction of the energy at said common port is coupled through each of said conductive traces.

3. Apparatus according to claim 1 in which said conductive extensions have a modified transverse width to provide impedance matching.

4. Apparatus according to claim 1 in which impedance matching stubs are included comprising a plurality of pairs of stubs one stub extending laterally from each side of each of said conductive trace extensions adjacent the interface with the corresponding conductive trace within said stripline.

5. Apparatus according to claim 2 in which impedance matching stubs are included comprising a plurality of pairs of stubs one stub extending laterally from each side of each of said conductive trace extensions adjacent the interface with the corresponding conductive trace within said stripline.

6. Apparatus according to claim 2 in which said conductive extensions have a modified transverse width to provide impedance matching.

7. Apparatus according to claim 3 in which impedance matching stubs are included comprising a plurality of pairs of stubs one stub extending laterally from each side of each of said conductive trace extensions adjacent the interface with the corresponding conductive trace within said stripline.

* * * * *